United States Patent [19]

Franke et al.

[11] Patent Number: 4,741,278

[45] Date of Patent: May 3, 1988

[54] SOLID FUEL AND A PROCESS FOR ITS COMBUSTION

[75] Inventors: Friedrich H. Franke, Fischbek; Michael J. Paersch, Aachen, both of Fed. Rep. of Germany

[73] Assignee: British Petroleum Company p.l.c., London, England

[21] Appl. No.: 855,850

[22] PCT Filed: Aug. 29, 1985

[86] PCT No.: PCT/GB85/00385

§ 371 Date: May 8, 1986

§ 102(e) Date: May 8, 1986

[87] PCT Pub. No.: WO86/01528

PCT Pub. Date: Mar. 13, 1986

[30] Foreign Application Priority Data

Mar. 9, 1984 [DE] Fed. Rep. of Germany ..... 3432365

[51] Int. Cl.[4] ..... F23B 7/00

[52] U.S. Cl. ..... 110/342; 44/620; 110/345

[58] Field of Search ..... 110/342, 343, 344, 345, 110/347; 44/1 R, 1 SR

[56] References Cited

U.S. PATENT DOCUMENTS

| | | | |
|---|---|---|---|
| 4,173,454 | 11/1979 | Heins | 44/1 SR |
| 4,191,115 | 3/1980 | Yang et al. | 110/345 X |
| 4,302,207 | 11/1981 | Paspek | 44/1 R |
| 4,388,877 | 6/1983 | Molayem et al. | 110/345 X |

FOREIGN PATENT DOCUMENTS 017419 10/1980 European Pat. Off. .

*Primary Examiner*—Edward G. Favors

*Attorney, Agent, or Firm*—Morgan & Finnegan

[57] ABSTRACT

A solid carbonaceous fuel containing up to 10% wt of calcium compounds and 0.1 to 5% wt of added iron added as oxide, carbonate or elemental iron or as substantially halogen and sulphate-free iron-containing substances forming iron oxide or carbonate under furnace conditions. The additives act synergistically to reduce $NO_x$.

2 Claims, 2 Drawing Sheets

SOLID FUEL AND A PROCESS FOR ITS COMBUSTION

Figure 1:
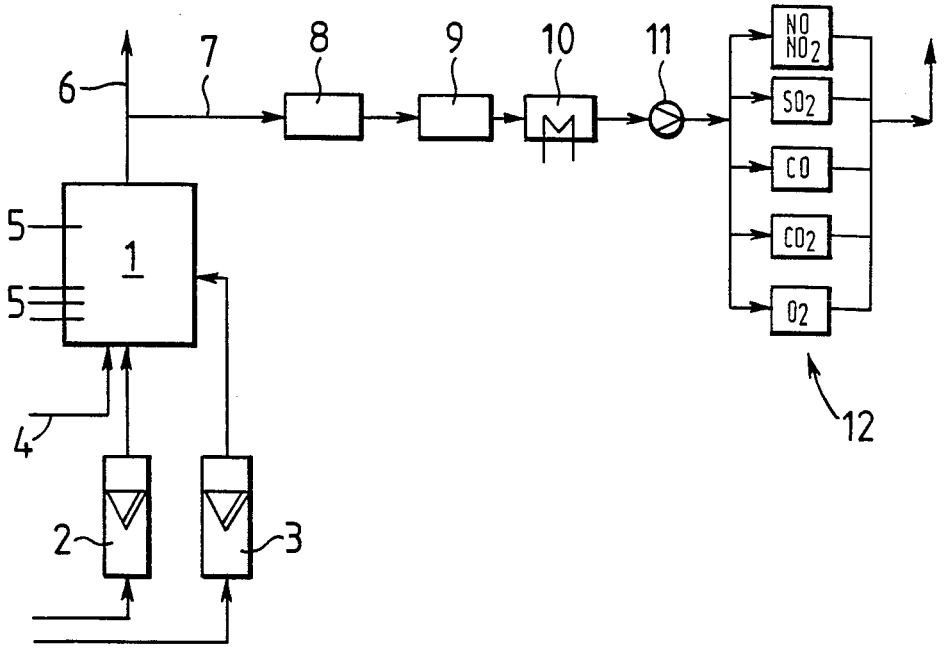

The present invention relates to a carbonaceous solid fuel.

Despite wide-ranging efforts, hitherto it has not proved possible to develop a technically simple and inexpensive process for the removal or reduction of $NO_x$ in the flue gases of coal-burning installations. To remove or reduce $NO_x$ and other undesired components of the flue gases, basically two type of process are used, on the one hand involving the influencing of the combustion cycle, e.g. by the addition of additives to the fuels, and on the other hand the removal of the undesired components from the flue gases themselves. The present invention relates in particular to the reduction of $NO_x$ according to the first-named type of process.

It is known e.g. from GB No. 2046781 to add calcium compounds to carbonaceous solid fuels to reduce the content of undesired components e.g. sulphur compounds in the flue gases.

U.S. Pat. No. 1,990,948 discloses that iron chloride or iron sulphate may be used in the production of solid fuel briquettes.

However, the presence of substantial quantities of chlorine or sulphate in feeds to combustion processes is generally undesirable because corrosion of metallic surfaces may take place, and because the combustion gases will contain harmful materials as a result.

U.S. Pat. No. 3,323,901 discloses the production of pellets containing iron ore, coal, and Portland cement. These pellets are for use as feed to an iron smelting process and therefore will contain substantial quantities of iron ore e.g. 60% by weight. The Portland cement is used as a binder.

There is no suggestion that the presence of iron has any advantageous effect on the level of undesirable components in the gases resulting from combustion. A skilled person reading the disclosure of U.S. Pat. No. 3,233,901 would not be led towards making solid fuels comprising coal, calcium compounds, and quantities of iron compounds less than those which would be present in feeds to iron smelting processes.

U.S. Pat. No. 2,844,112 discloses a method of inhibiting slag formation in boilers fired with residual petroleum by adding various materials to the feed including calcium compounds and iron compounds. However solid carbonaceous materials such as coal behave differently from residual oil fuels as far as slag formation is concerned. Skilled persons would not be led towards adding to coal materials used to inhibit slag formation in residual fuels.

We have now found that a solid fuel with a reduced tendency to form $NO_x$ on combustion can be obtained by using a specific combination of additives.

According to the present invention there is provided a solid carbonaceous fuel containing added calcium compounds characterised in that it contains up to 10% wt, calculated on dry and ash free (daf) solid carbonaceous fuel of calcium oxide or an equivalent quantity of calcium hydroxide, calcium carbonate and/or substances forming these compounds under furnace conditions and also 0.1 to 5% by weight, based on dry ash free (daf) carbonaceous fuel, of added iron added as iron oxide, carbonate, elemental iron or as substantially halogen-free and sulphate-free iron-containing substances forming iron oxide or carbonate under the furnace conditions.

Examples of compounds forming CaO under the furnace conditions are calcium soaps e.g. CaO, Ca(OH), $CaCO_3$, or as materials containing substantial amounts of them in free form or combined as, eg dolomite $CaCO_3.MgCO_3$.

The reference to equivalent quantity of other calcium compounds is to be understood as measuring the quantity of the compound providing the same amount of Ca as calcium oxide.

The iron oxide, iron carbonate and/or elemental iron may be fed in substantially pure form. Alternatively they may be fed as iron-rich minerals or industrial waste substances of iron oxide or carbonate, e.g. basic iron hydroxides, waste containing iron from metallurgy, e.g. iron oxide dust, blast furnace dust, blast furnace slurry, LD slurry, roller scale, roller slurry or red mud; iron-rich here means an iron content of at least 20, especially 30 to 60 percent by weight.

The solid carbonaceous fuel may be hard coal in the form of coal fines or coal dust, coal coke, petroleum coke, or lignite. The fuel can be used in pulverised form for use in pulverised furnace installations, but use in the form of agglomerates, especially pellets, is also advantageous. Pellets with particularly advantageous properties, for which the additives of the invention may find application, are known from DE OS No. 3321683 (corresponding to EP No. 97486.

Advantageously the additives of the invention are present in the fuels in a finely-divided or finely-dispersed form; a particularly fine and advantageous distribution is obtained in pelletising according to DEOS No. 3321683, especially in the presence of sugar-containing substances.

The synergistic effect already mentioned of the individual components in the additives of the invention are determined on the basis of tests, a report on which is given below.

DESCRIPTION OF THE COMBUSTION PLANT

Figure 2:
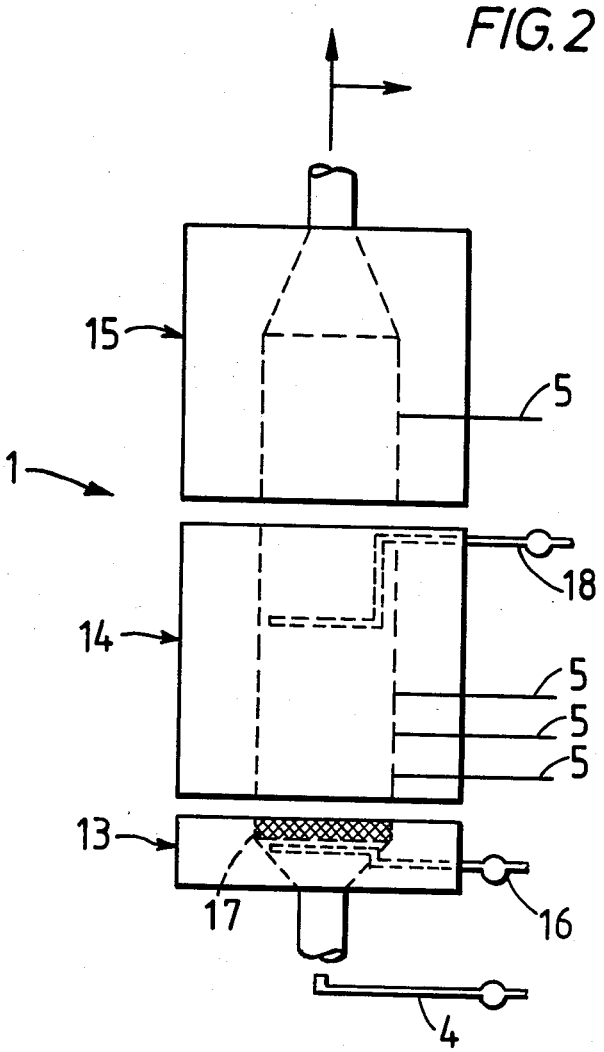

The structure of the combustion plant is shown in diagram form in FIG. 1, and that of the combustion furnace in FIG. 2.

A laboratory furnace 1 is supplied with combustion air through flow meters 2 and 3. Gas for igniting the furnace may be supplied through line 4. Pt-Re thermocouples are provided at 5. The gas from the furnace is fed to a stack (not shown) through line 6. A gas stream is taken off through line 7 and fed successively through a coarse filter 8, fine filter 9, cooler 10 and pump 11 to a gas analyser 12 and then to a stack (not shown).

The construction of the furnace will now be described in more detail with reference to FIG. 2.

The cylindrical combustion furnace made of high-temperature resistant steel has three sections 13, 14 and 15:

the blower area with grate in high-temperature resistant steel as the bottom part and the under-air (16) to perforated plate (17) beneath it, the cylindrical centre part for receiving the coal and the upper-air feed (18) designed in the form of a ring, the head, with free space as the top part.

The cylindrical hearth has a clear internal diameter of 150 mm and a free height of a total of 600 mm, the cylindrical internal diameter tapering at the head to 50 mm diameter. The casing likewise consists on the outside of a high-temperature resistant steel and on the inside has the following insulation:

an insulating mat in ceramic, an insulating cast mat, a refractory insulating material produced by tamping granular material.

Pt-Rh thermocouples are incorporated into the centre part which is impinged on by the coal, and into the free space of the upper part a further thermocouple is incorporated.

The flue gases leave the top part of the furnace and pass into a chimney; a partial stream of flue gases is aspirated for analysis. This partial stream is double-filtered to remove tar and dust, and cooled to 2° C. to lower the partial water pressure. The flue gas thus treated is then continually analysed for the gas components $NO_x$, $SO_2$, CO, $CO_2$ and $O_2$.

Performance of the Combustion Test

After calibration of the analysers to determine the flue gas components, at the commencement of the test the top part of the combustion furnace is lifted. 1 kg of lump coal (coal pellets with a mean diameter of 10 mm) is fed in, the height of the layer of coal resulting in around 10 cm. After this the furnace courses lying on top of each other are sealed and the four thermocouples installed. By means of a gas burner the coal is ignited through the perforated plate of the lower part of the furnace. Next the coal is impinged on by air (8 to 12 $Nm^3/hr$), the proportion of under-air amounts to about 70% and the proportion of upper-air about 30%.

The combustion temperature rise, depending on the type of coal, during the combustion to some 1500° C.

After a test period of about 30–50 mins, depending on air throughput and type of coal, the combustion is practically terminated, which can be ascertained by analysis ($O_2$, $CO_2$) and the temperature curve.

The combustion furnace, as regards temperature curve and exhaust gas composition, simulates the combustion process, as a function of the time, which develops on a normal industrial travelling grate as a function of the length of the grate.

Production of the Coal Pellets

The test pellets were produced from Middelburg coal. The following were used as binder for the pelletising: 2 to 8 percent by weight water-soluble or water-swellable organic binders for basic strength, e.g. types of molasses or starch derivatives (in the special example described below: 8 percent by weight cane molasses (45 percent by weight water), reckoned on coal (daf).

1 to 3 percent by weight weather-resistant and water-repellent surface protection, e.g. bitumina and other refining residues (Visbreaker) in emulsified form (in the following special example: 2 percent by weight bitumen emulsion (40 percent by weight water), reckoned on coal (daf).

As additives, 5 percent by weight slaked lime (approx. 96% $Ca(OH)_2$), which met the DIN standard for "Weissfeinkalk" and/or 3 percent by weight iron oxide dust (approx. 64% iron) were added; the percentages by weight again relate to coal (daf).

Pellet production was carried out according to the example of execution in DE-OS No. 3321683 (EP No. 97486).

Pellet Combustion

On the basis of the results from the continuously recording gas analysers, the $NO_x$ emission was determined. A comparison of the integral $NO_x$ overall emission by the pellets without additives, with an addition of the individual components and an addition of the additive combination respectively, shows the decrease in $NO_x$ in the flue gas which can be seen from the following table; the combustion conditions (approx. 12 $Nm^3/hr$ air) were identical, the results are reproducible to a good extent. $NO_x$ is given as mg of $NO_x$, calculated as $NO_2$, per kg of coal (daf).

| Additive | $NO_2$ (mg/kg) | $NO_2$ decrease (%) |
|---|---|---|
| None | 1530.6 | 0 |
| 5% slaked lime | 1372.6 | 10 |
| 3% iron oxide dust | 1338.8 | 12.5 |
| 5% slaked lime and 3% iron oxide dust | 824.9 | 46 |

The result shows the synergistic effect of the combination of $Ca(OH)_2$ and $Fe_2O_3$ in regard to the decrease in the emission of $NO_x$.

We claim:

1. Process for the production of pellets from finely divided coal or carbonaceous materials, using a first heat hardening binding agent which is water-soluble or water-swellable, and a second binding agent based on aqueous emulsions of heavy hydrocarbons, the process comprising the steps of:

(a) forming a mixture by adding to the coal (i) up to 10% by weight calculated on the coal (daf) of calcium oxide; and (ii) 0.1 to 5%, calculated on coal (waf), of iron in the form of an iron compound selected from the group consisting of iron oxide, iron carbonate, elemental iron, substantially halogen free and sulfate free, iron rich minerals and substantially halogen free and sulfate free, iron rich technical by-products;

(b) agglomerating said mixture with said binding agent in a pelletising device to produce a concentration gradient of binding agent in the pellets by controlled addition of said firt and second binding agents in the course of pelletisation, so that the concentration of the first binding agent decreases from the inside of the pellet to the outside and that of the second binding agent decreases from the outside to the inside; and (c) thermally drying and subsequently thermally hardening the pellets.

2. A process as in claim 1 wherein an equivalent quantity of a calcium compound selected from the group consisting of calcium hydroxide, calcium carbonate, substances containing these compounds and substances which form these compounds under combustion conditions is substituted for calcium oxide.

* * * * *